United States Patent [19]

Daniels et al.

[11] Patent Number: 4,481,654

[45] Date of Patent: Nov. 6, 1984

[54] X-RAY TUBE BIAS SUPPLY

[75] Inventors: Herbert E. Daniels, Brown Deer; Vern R. Petersen, Brookfield, both of Wis.

[73] Assignee: General Electric Company, Schenectady, N.Y.

[21] Appl. No.: 417,715

[22] Filed: Sep. 9, 1982

[51] Int. Cl.[3] ..... H05G 1/30

[52] U.S. Cl. ..... 378/110; 378/106; 378/112; 378/113

[58] Field of Search ..... 378/113, 110, 112, 106

[56] References Cited

U.S. PATENT DOCUMENTS 4,361,901 11/1982 Daniels ..... 378/110

OTHER PUBLICATIONS

"The Supply Specifier Has A Basic Choice", Electronics, Jun. 16, 1981, pp. 108–114.

*Primary Examiner*—Craig E. Church

*Attorney, Agent, or Firm*—Fuller, House & Hohenfeldt

[57] ABSTRACT

A power supply is switchable to apply a low kilovoltage and a relatively higher kilovoltage alternately to the anode of an X-ray tube that includes a filament and a control grid. A grid bias voltage generator uses an inverter driven in the kilohertz frequency range to feed the primary winding of a first transformer whose parasitic capacitance and inductance are used to produce a peak ac output voltage from the secondary of the first transformer at resonant frequency. The secondary output voltage is rectified and the resulting negative bias voltage is applied to the control grid synchronously with the high kilovoltage being applied to the anode so the X-ray tube current is then relatively low. A less negative or zero bias voltage is applied to the grid synchronously with the lower kilovoltage being applied to the anode so the X-ray tube current is then relatively high and substantially limited by the temperature and emissivity of the filament. A second transformer identical to the first one is used to sense the ac output voltage of the first one. A voltage-to-frequency converter switches the inverter. The resonant circuit ac output voltage sensed by the second transformer is rectified and compared with a selectable dc control signal and any resulting error signal is used to adjust the converter frequency and, hence, the inverter frequency so the bias on the X-ray tube grid voltage is proportional to the dc control signal level.

8 Claims, 2 Drawing Figures

X-RAY TUBE BIAS SUPPLY

BACKGROUND OF THE INVENTION

This invention relates to a circuit for controlling the bias voltage on an X-ray or other type of vacuum tube to provide for the tube conducting low current when there is a high voltage drop between its anode and cathode and high current when there is a low voltage drop between its anode and cathode.

The new bias control was developed primarily for solving the problems that arise in connection with switching an X-ray tube between high energy and low energy output states as is required in digital fluorography, particularly hybrid digital subtraction fluorography (DSF).

One hybrid DSF method requires projecting low and high energy X-ray beam pulses of several millisecond durations alternately through a patient. It is desirable for the pulses to be separated by no more than two television frame times. There may be 50 to 80 high and low energy pulse pairs produced in a typical X-ray exposure sequence extending over several seconds. By way of example, and not limitation, the peak kilovoltage applied to the anode of the X-ray tube may be around 135 kilovolts for the high energy exposures and the X-ray tube current may be on the order of 100 milliamperes (mA). For the low energy exposure pulses, the peak anode voltage may be on the order of 70 kilovolts and X-ray tube current may be as high as 1000 mA. Usually, the individual X-ray pulses will be delivered within a single television frame time which is typically 1/30 or 1/25 of a second.

The terms low X-ray energy and high X-ray energy are used for convenience. It would be more accurate to say that they are low and high average energy X-ray pulses. This is for the well-known reason that even when an absolutely constant voltage is applied to the anode of an X-ray tube some of the output X-ray photons will have peak energy while others will have lower energy. In other words, there is a spectral distribution of energies within particular low and high energy limits.

Generally, an X-ray image intensifier is used to convert the different energy X-ray images to optical images which are viewed by a television camera. The analog video signal frames are converted to digital picture elements (pixels) for further processing in accordance with the requirements of digital subtraction fluorography. One use of DSF is, of course, to provide the physician with an image of the interior of blood vessels in a region of interest within the patient's body. Visualization is enhanced by making some exposures subsequent to the time an X-ray contrast medium, such as an iodinated compound that has been injected into the circulatory system, arrives at and flows through the vessels that are the subject of the arteriographic examination. Post-contrast arrival images are then subtracted from pre-contrast images to produce a sequence of difference images in which soft tissue and bone are subtracted out while the contrast medium remains to enable visualization of the interior outline of the vessel.

In one hybrid digital subtraction fluorography mode, a sequence of rapidly occurring low and high energy exposures are made continuously through the pre-contrast interval, the post-contrast interval and an after-post-contrast interval. The first low energy exposure or image is retained in a memory as a mask. Similarly, the first high energy exposure image is stored in a memory as a mask. Then all of the subsequent low energy images in the sequence are subtracted from the mask and the resulting series of difference images are converted to analog video format and stored on video disk. The alternate subsequent high energy images are subtracted from the high energy mask and stored on disk. Subtracting images or exposures made at identical energy levels with a substantial amount of time between them is called temporal subtraction. This type of subtraction cancels everything that is unchanged in the respective images. For instance, ordinarily bone and soft tissue attenuation will be unchanged from image to image but projected intensity of the contrast medium will not be so substantially everything but the contrast medium will subtract out or cancel. If there is substantial movement of the patient's tissue such as due to peristalsis or coughing in the course of a temporal subtraction procedure, there will be motion artifacts in the subtracted images which will not cancel. Noise and motion artifacts may be eliminated by resorting to hybrid subtraction.

For hybrid subtraction, all of the low energy temporal difference images are summed. Similarly, all of the high energy temporal difference images are summed. Then the results of the two summations are subtracted to produce a final difference image in which soft tissue and bone and anything else that remains constant is cancelled out while the contrast medium that defines the blood vessel remains.

In any case, it is desirable to be able to produce the low and high X-ray energy pulses in a pair rapidly and as close together as possible so there can be no substantial involuntary movement of the patient between a low energy pulse and the next ensuing high energy pulse.

Besides a hybrid subtraction requiring accurate timing of the X-ray pulses, it is important to apply the identical kilovoltage and have the same X-ray tube current for every low and high energy exposure in a sequence. It is also necessary for the X-ray tube current or mA to be low for high kilovoltage and for the mA to be high for low kilovoltage so that the intensities of the photons that emerge from the body are substantially identical for the low and high energy exposures.

The bias voltage applied to the grid of an X-ray tube can be reduced to zero volts for the low energy or low kilovoltage pulses, allowing full mA, and a more negative bias voltage can be applied during the alternate high kilovoltage pulses, allowing reduced mA to maintain approximately constant wattage from pulse to pulse at each energy. There are several known X-ray tube grid bias control systems. They usually employ a transformer that is in an oil-filled tank for producing an alternating voltage that is rectified and switched from pulse to pulse to obtain zero bias voltage for the low energy exposures and, by way of example and not limitation, −3000 volts dc for the low current, high kilovoltage or high energy exposures. The size of the bias equipment and the insulating requirements for isolating the bias circuits from high kilovoltage circuits up to about 150 kilovolts for the X-ray tube anode results in equipment that is costly, voluminous and subject to failure, especially in the switching circuit.

The prior art circuits do not allow for selectability or fine tuning of the different bias voltages. They do not permit free choice of X-ray tube current and tube kilovoltage combinations. For instance, there are occasions where the body part being fluorographed requires different low and high energy X-ray tube currents and voltages than other parts of the body in order to get the best images for subtraction.

SUMMARY OF THE INVENTION

The new X-ray tube grid bias control described herein is distinguished by its ability to permit selection of a wide range of X-ray tube currents and voltages for the low and high energy X-ray exposures. It is further distinguished by size reduction of the equipment as compared with the prior art and, importantly, by reduction of manufacturing cost as well.

An important advantage of the new bias voltage supply is that it permits elimination of sensitive electronic components from the high voltage X-ray tube and power supply environment.

In accordance with the invention, bias voltage is obtained with a circuit whose first stage is a dc-to-ac inverter. The inverter output is applied to the primary of a step-up transformer. The secondary of this transformer is connected to a full-wave rectifier. The transformer secondary leakage inductance and the secondary winding and other parasitic capacitance are utilized in a manner comparable to an LC tank circuit to obtain resonance at a particular inverter frequency. No components need be added to do this. A full-wave rectifier in the output of the transformer secondary winding has its dc terminals connected between the cathode and grid of the X-ray tube. Use of a high frequency, say 100 kHz or more, allows the capacitance of the cable that is used to make the connection to the cathode and grid of the X-ray tube to be used for filtering out any ripple in the bias voltage. Thus, filtering is obtained without the need to add any component for that specific purpose. This also assures minimum capacitance for permitting fast response and minimum power dissipation in connection with bias voltage production and switching.

A feedback or servo circuit is used for controlling the inverter to operate at a particular selected voltage and frequency level. For the feedback circuit, another transformer is used. It is identical to the transformer that is driven by the inverter. This has the advantage of minimizing loading effects on the transformer since the circuit operates the same with and without the feedback transformer both in voltage and frequency output.

How the foregoing and other features of the invention are achieved will become evident in the more detailed description of a preferred embodiment of the invention which will now be set forth in reference to the drawings.

DESCRIPTION OF A PREFERRED EMBODIMENT

Figure 1:
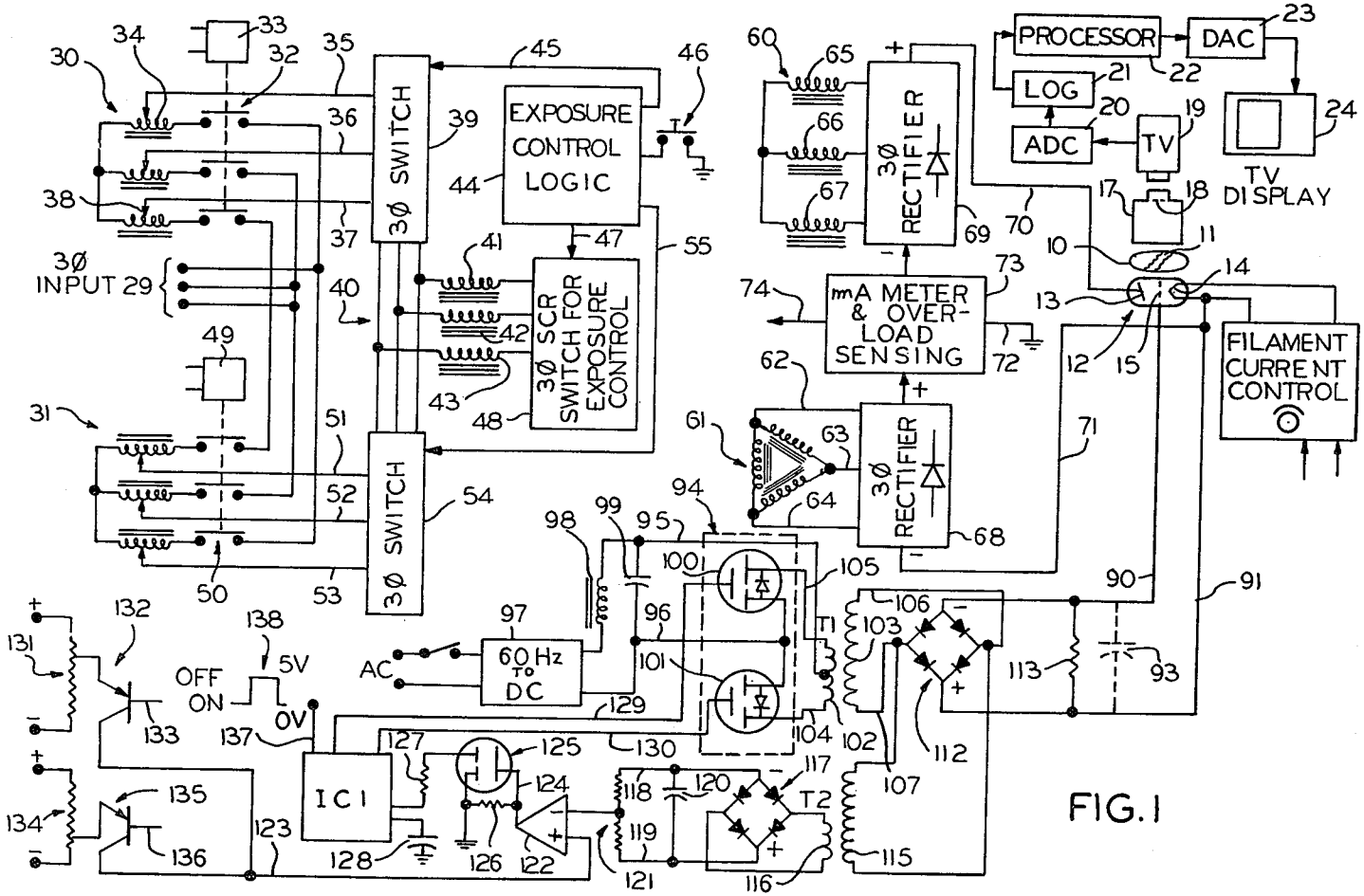
FIG. 1 is a block diagram of an X-ray power supply circuit in conjunction with an X-ray exposure system and the new X-ray tube bias control system.

In the upper right region of FIG. 1 a simplified system, suitable for performing digital subtraction fluorography, is shown. The patient to be subjected to an arteriographic study is symbolized by the ellipse marked 10. A blood vessel of interest and containing X-ray contrast medium is indicated by the numeral 11. The X-ray tube is marked 12. It comprises the usual high vacuum envelope containing an anode target 13 and a cathodic filament 14. A control electrode, hereafter called a grid 15 is symbolized by a dashed line and is interposed between the filament and anode of the tube. The X-ray tube current is highest and the kilovoltage drop across the anode-to-cathode circuit of the X-ray tube is lowest when the grid has a zero or slightly negative bias voltage applied between it relative to the cathode. The tube current is lower and the kilovoltage drop between the anode and cathode is higher when the grid-to-cathode voltage is highly negative. By way of example and not limitation, typically the highest negative bias voltage would be on the order or −3000 volts dc. During any high and low energy X-ray exposure sequence, the magnitude of the current flowing through cathode filament 14 is maintained constant. This means that filament temperature and its electron emissivity will be constant and emission limited during the low kilovoltage-high current exposures. Thus, the X-ray tube electron beam current will always have a set maximum value during the low energy exposure cycles and will be subject to suppression when the bias voltage is applied to the grid as it is during the high kilovoltage, high energy exposure cycles. The filament current control that allows for setting the filament temperature and, hence, maximum emissivity is symbolized by the block marked 16 and can be easily devised by anyone skilled in the X-ray tube power supply design field.

In FIG. 1, the X-ray images resulting from the low and high X-ray energy exposures are received by an image intensifier that is generally designated by the reference numeral 17. This conventional intensifier converts the X-ray images to minified and very bright optical images which appear on an output phosphor that is represented by the dashed line 18. The visible image on phosphor 18 is converted on the target, not visible, of a video or TV camera 19 to a charge pattern image. For the purposes of the invention, the TV camera target is scanned or read out in the progressive scanning mode after each low and high energy exposure. The analog video signals that are outputted from the TV camera 19 for every image frame are converted to digital picture element (pixel) signals in an analog-to-digital converter (ADC) 20. The digital pixel signals are converted to equivalent logarithmic values in a logarithm look-up table (labelled log) 21 for reasons which are well known to those skilled in the X-ray art. The functions of subtracting images and forming difference images and the video disk recording discussed earlier are lumped together and assumed to be carried out in a single block which is labelled as a processor and marked 22. Temporal and energy subtracted images are converted back to analog video signals with a digital-to-analog converter (DAC) 23 whereupon they are used to drive a TV monitor 24 for displaying the image or images.

Besides the known X-ray exposure and signal processing system just described, the system in FIG. 1 comprises two other major parts, namely, a high voltage three-phase power supply and the new X-ray tube bias control circuitry.

The high voltage three-phase power supply will be considered first. The power supply comprises two three-phase autotransformers 30 and 31. Autotransformers identified by the General Electric Company trademark "Voltpac" are suitable. The three-phase lines constituting the power supply input from the 60 Hz power lines are labelled three-phase input and are marked 29. Typically, the input voltage is 480 volts ac. Autotransformer 30 is active when high energy or high kilovoltage is to be applied to the X-ray tube anode-cathode circuit. Autotransformer 31 is active and transformer 30 is inactive during low energy exposures as when low kilovoltage is to be applied to the X-ray tube. The power lines connected to the input of the Y-connected autotransformer windings have three safety contacts 32 in them which are controlled by a solenoid 33 that is energized to close the contacts when an X-ray exposure sequence is contemplated. The three autotransformer windings are designated generally by the reference numeral 34. The three-phase output lines from autotransformer 30 are marked 35, 36 and 37. A typical tap switch for selecting the desired output voltage from the autotransformer secondary winding is marked 38. The three tap switches are ganged so the voltages between phases remain in balance. The output lines 35–37 are inputted to a three-phase switching circuit that is symbolized by the block marked 39. This switching circuit can be implemented using silicon controlled rectifiers (SCRs), not shown, as switching devices for anyone reasonably skilled in the X-ray power supply art. In any event, the switches control power on a three-phase bus 40 to which the three-phase primary windings 41, 42 and 43 of an iron core transformer are connected. A block marked 44 and labelled exposure control logic is operative to provide the gating signals by way of a control line 45 for turning on and off the SCR devices in three-phase switching circuit 39. A hand-operated switch 46 is closed to initiate an exposure sequence. When switch 46 is closed, the exposure control logic is operative to cause the SCR switches in block 39 to conduct and thereby connect the primary windings 41–43 of the iron core transformer to the output of the autotransformer 34 by way of bus 40. Thus, a particular voltage having a value depending on the adjustment of autotransformer 30 is applied to the three-phase transformer primary windings when three-phase switch 39 is closed or conducting. The exposure control logic also provides switching or gating signals through a line 47 to another three-phase switching circuit represented by the block marked 48 and labelled three-phase SCR switch which simply connects the ends of the primary windings 41–43 together so the primary becomes star or Y-connected and conductive.

The other autotransformer arrangement 31 is also supplied from the three-phase input when line contactor solenoid 49 is energized to close its three contacts 50. The output lines 51, 52 and 53 from the three-phase autotransformer 31 are inputted to a three-phase SCR switching circuit 54 which has the properties of switching circuit 39 as previously described. Autotransformer 31 provides on its output lines 51–53 three-phase voltage that is lower than provided by the other autotransformer 30 on its output lines 35–37. In any event, switching circuit 54 connects the primary windings 41–43 of the high voltage iron core transformer to the autotransformer 31. Exposure control logic 44 provides gating signals by way of a line 55 for the three-phase SCR switching circuit 54. In this particular design, when an alternating low and high energy exposure sequence is initiated, the exposure control logic 44 renders the three-phase switches in switching circuit 54 conductive and applies the lower of the two autotransformer output voltages to the primary windings 41–43 of the iron core transformer. Next the exposure control logic renders the SCR circuits in three-phase switching circuit 39 conductive so as to energize the primary windings 41–43 from autotransformer 30 so the higher of the two voltages is applied to the primary of the three-phase transformer. The exposure control logic continues switching back and forth to cause power to be sourced from alternate autotransformers during the entire exposure sequence at a rate on the order of the television frame rate if desired.

There are two high kilovoltage secondary windings on the same three-phase transformer core as the low voltage primary windings 41–43. One of the three-phase secondary winding sets is marked 60 and its three coils are connected in the Y-configuration as shown. The other secondary winding 61 is delta-connected. The delta connected secondary output kilovoltages on lines 62, 63 and 64 are 30° out of phase with the output lines 65, 66 and 67 of the Y-connected secondary windings 60. The three-phase output lines 62–64 of delta connected secondary 61 are input to a three-phase rectifier circuit symbolized by the block marked 68. The three-phase output lines 65–67 from the Y-connected secondary windings are input to another three-phase rectifier circuit symbolized by the block marked 69. The two rectifier circuits 68 and 69 are in series circuit with the X-ray tube 12. The positive terminal of the rectifier circuit connects to the anode 13 of the X-ray tube by way of a line 70. The negative terminal of the rectifier circuit connects to the cathode or filament 14 of the X-ray tube by way of a line 71. The mid-point of the rectifier circuit is grounded as at 72. mA metering and overload sensing is done in a conventional manner at ground potential level in a block that is so labelled and given the reference numeral 73. A line 74 delivers a signal to an overload relay, not shown, which opens the three-phase input lines 29 if overload current through it is sensed. Both three-phase transformer secondary windings 60 and 61 are energized at any time that the primary windings 41–43 are energized with either the lower or the higher of the two primary voltages available from the respective autotransformers 30 and 31. The fact that the Y-connected and delta connected three-phase secondary windings 60 and 61 are 30° out of phase with each other results in twelve 60 Hz ripples being present on the top of each X-ray current pulse which allows the X-ray tube voltage and current pulses to approximate square waves.

Figure 2:
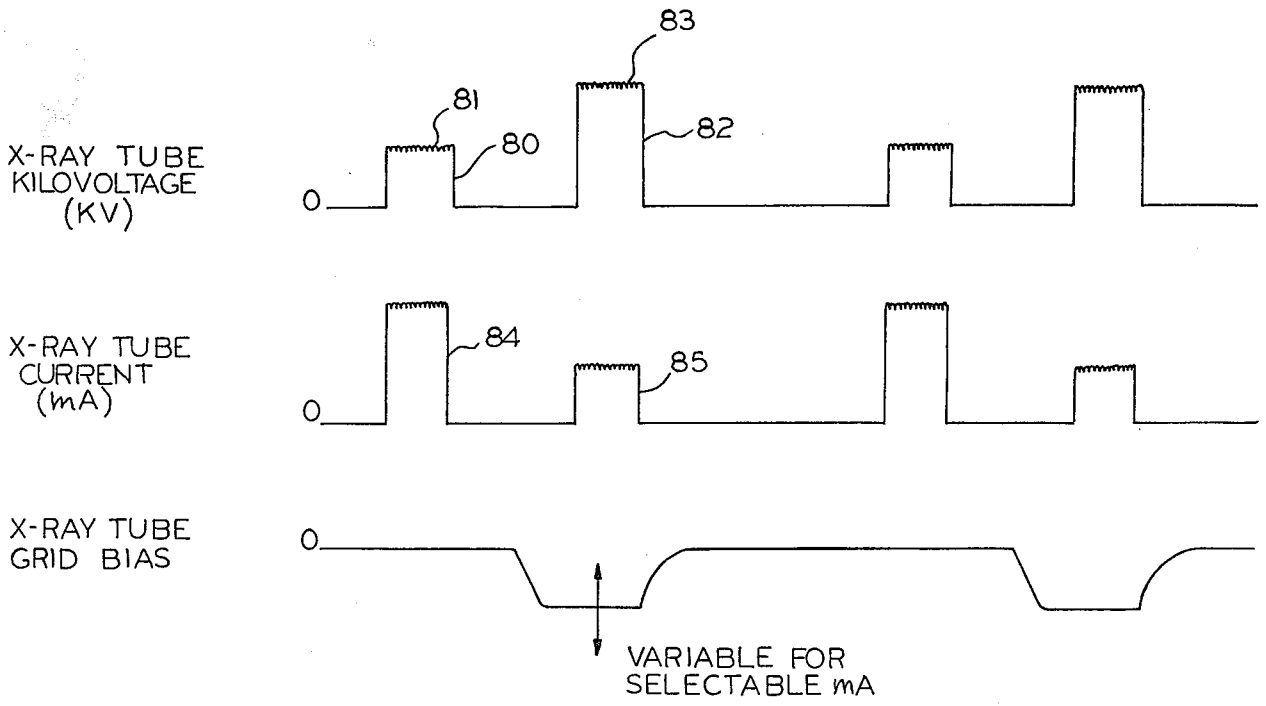
FIG. 2 shows some timing diagrams that are useful for explaining the bias control function.

By way of example, in the FIG. 2 diagram any low kilovoltage pulse 80 will have a 12-cycle ripple 81 superimposed on it and the same is true of the high voltage pulses 82 which will have 12-cycle ripple 83. If, for example, both transformer secondary windings were connected in the same fashion, that is, either in Y or delta there would be a three-cycle ripple on the kilovoltage pulses and a smoothing or filtering circuit might be called for. The X-ray tube high current pulses 84 and the low current pulses 85 also, of course, manifest low ripple. As shown in FIG. 2, the low X-ray tube kilovoltage pulses 80 are accompanied by high X-ray tube current pulses 84 and the high X-ray tube kilovoltage pulses 82 are accompanied by low X-ray tube current pulses 85. How this is achieved and how X-ray tube current is controlled independently with the new resonant transformer bias circuit will be discussed in greater detail shortly hereinafter.

The new resonant circuit X-ray tube bias control will now be described in reference to FIG. 1. As has already been explained, the high or most negative bias voltage is applied to control grid 15 of the X-ray tube during the pulses at which the X-ray tube current is relatively low and the voltage drop across the anode-cathode of the tube is relatively high. A lower bias voltage, that is, a less negative bias voltage or zero bias voltage is applied to the control grid during pulse intervals when X-ray tube current is to be maximum and a lower voltage drop is to be produced across the X-ray tube. The high voltage cable, specifically, the conductors 90 and 91 provide a small amount of capacitance which, as previously explained, is utilized for filtering the bias voltage. This capacitance is represented by a symbolic capacitor 93 that is depicted in dashed lines.

The bias control circuit comprises a dc-to-ac inverter contained within the dashed line rectangle 94. The dc input lines to the inverter are marked 95 and 96. The dc voltage is supplied from a full-wave rectifier represented by the block marked 97. An inductor 98 and a capacitor 99 smooth the ripple in the rectified dc. The inverter includes two power type metal oxide silicon field-effect transistors 100 and 101 for switching the dc current through alternate paths. One dc input line 96 is connected to a point between the transistors. The other dc input line 95 is connected to the center tap in the primary winding 102 of a transformer T1 whose secondary winding is marked 103. The ac output lines from the inverter are marked 104 and 105 and connect to opposite ends of the primary winding 102 of transformer T1. The inverter outputs a square wave alternating voltage which is applied to the primary winding of transformer T1.

The gate signal terminals of field effect transistors 100 and 101 are connected by way of lines 129 and 130 to an integrated circuit IC1 which will be discussed more fully later. For the present it is sufficient to recognize that IC1 contains an oscillator and switches lines 129 and 130 back and forth alternately from a low signal level state to a high state at the desired inversion frequency. The gate signals cause the transistors 100 and 101 to conduct alternately. As is well known, when transistor 100 conducts current flows in one direction from the center tap of primary winding 101 through one-half of the winding and when transistor 102 conducts current flows oppositely through the other half of the primary winding, thereby inducing the alternating current in the secondary winding 103 of transformer T1.

Inverters of a type different from inverter 94 could be used, of course. Any inverter that permits varying its ac output frequency in correspondence with variable frequency switching or gating signals may be used. In an actual embodiment, the inverter system is capable of producing alternating current in the 80 kHz to 230 kHz range.

As has been stated and is known, transformer T1, like other transformers has leakage inductance and winding capacitance. In accordance with the invention, the inverter 94 can be adjusted to provide a frequency at which all of the inductance and capacitance will produce resonance at which time peak voltage will occur across the secondary output lines 106 and 107 of transformer T1. As inverter frequency is increased, or departs increasingly from resonant frequency, the ac output voltage from transformer T1 declines. It is usually desirable to operate at or above resonant frequency so that the resonant circuit appears as a lagging load to the inverter. Although square wave input pulses are supplied from the inverter 94 to the primary of transformer T1 either at or near the resonant frequency, the waveform on ac output lines 106 and 107 is substantially sinusoidal. A full-wave rectifier bridge 112 rectifies the sinusoidal output voltage. The negative side of rectifier 112 is connected to the X-ray tube control grid 15 by way of cable conductor 90 to provide the appropriate negative bias voltage for low and high energy pulses to control grid 15. The positive side of rectifier 112 is connected to the filament of the X-ray tube by way of cable conductor 91. In a practical embodiment, the inverter frequency is adjustable over a range that allows a negative bias voltage maximum of about −3000 volts dc on the control grid 15 relative to the filament 14 of the X-ray tube.

A high value resistor 113 is connected across the high voltage supply conductors 90 and 91. The stray cable capacitance represented by capacitor 93 charges up to a voltage that is limited by the impedance of the transformer T1 and discharges through resistor 113 when bias voltage turns off by means which will be described. Because cable capacitance is small and frequency is high, a high value resistor 113 can be used so the time constant is still very short and the bias voltage is dissipated rapidly. Thus, switching between low and high bias voltages can be carried out at a high rate. Minimum power is consumed by virtue of being able to use a high value resistor 113. In a practical embodiment, a 300 kilohm resistor is used and, by way of example, power dissipation is only 30 watts. If it were not for the high resonant frequency, it would be necessary to use a large capacitor instead of simply using cable capacitance 93 and to use a low value resistor 113 to get a quick discharge in those cases where the high and low energy pulses must be very close to each other and thus require a fast bias voltage switching rate.

The output frequency of inverter 94 and hence, the sinusoidal voltage level between the output lines 106 and 107 of the secondary winding of T1 at or near resonance is regulated or stabilized with a servo loop that will now be described. The input of the servo loop is the primary winding 115 of a transformer T2. Its secondary winding is marked 116. Primary winding 115 is connected across the ac input terminals to rectifier bridge 112. Thus, an ac voltage corresponding to the dc voltage applied between the grid 15 and cathode 14 of the X-ray tube is fed to the primary winding 115. The secondary winding 116 of transformer T2 is connected to the ac input terminals of another full-wave rectifier bridge 117. Thus, dc voltage appears across output lines 118 and 119 of the rectifier bridge. This dc voltage is proportional to the bias voltage applied between control grid 15 and cathode 14 of the X-ray tube. A capacitor 120 is used to filter ripple from the dc voltage. A voltage divider 121 is connected across the dc lines. A point on the divider is connected to the inverting input of a summing amplifier 122. A control voltage is supplied by way of line 123 to the non-inverting input of amplifier 122. As will be described, the negative bias voltage applied to the control grid 15 of the X-ray tube is proportional to the control voltage supplied by way of line 123 to amplifier 122. The control voltage is selectable so that at least two different X-ray tube bias voltage levels can be provided for any given exposure sequence. One bias voltage can be applied to the X-ray tube grid 15 synchronously with the high voltage being applied to the anode of the X-ray tube which at that time would provide the high energy X-ray pulse. Another bias voltage level can be supplied to the grid when the low kilovoltage is being applied to the X-ray tube anode for developing the low energy X-ray pulses. How the bias voltage and kilovoltages applied respectively to the grid and anode of the X-ray tube are synchronized will be explained later.

The output of the summing amplifier 122 is, in effect, an error signal which corresponds to any error between the control voltage and the voltage derived from the feedback loop by way of divider 121. This error signal is inputted by way of a line 124 to the gate of a field-effect transistor 125. The voltage drop across a resistor 126 is the biasing voltage for the transistor. This transistor functions as a variable resistance device. It has a current limiting resistor 127 connected to one of its electrodes. The current flowing through resistor 127 is inputted to an integrated circuit, IC1. In an actual embodiment this integrated circuit is a type TL 494 CN available from Motorola Semiconductor Products or Texas Instruments, Inc., by way of example. It contains an oscillator that can be controlled to oscillate at a frequency corresponding to the frequency at which it is desired to drive inverter 94. Resistor 127 together with field-effect transistor 125 and a capacitor 128 constitute an RC time constant circuit and the values of these components govern the output frequency of IC1. Basically, it is the controlled current through resistor 127 that provides the time constant and governs the output frequency of IC1. The output frequency signal from IC1 is an input by way of lines 129 and 130 to inverter 94. The signal on these lines gates the switching field-effect transistors 100 and 101 in the inverter alternately into conductive and nonconductive states as explained earlier so that the corresponding frequency is provided to primary winding 95 of transformer T1. Basically, summing amplifer 122, transistor 125 and IC1 form a voltage-to-frequency converter.

The output frequency of inverter 94 has to be at one value for the low energy X-ray pulses and another value for the high energy X-ray pulses. Thus, it must be switched in synchronism with application of the high and low kilovoltages to the X-ray tube anode. And, as stated earlier, two different control voltages must be supplied to the noninverting input of summing amplifier 122 for two different bias voltages. In the illustrative circuit, a higher dc control voltage will cause lower frequency input to transformer T1 from inverter 94 and, hence, a higher negative bias voltage on the X-ray tube control grid 15. Similarly, a lower control voltage will cause a lower bias voltage on control grid 15. The higher control voltage is provided from a potentiometer 131 whose wiper connects to the emitter of a transistor 132. The collector of this transistor feeds a common line 123 that connects to the noninverting input of amplifier 122. The base or control electrode 133 of transistor 132 is provided with a driving signal in synchronism with the high kilovoltage being applied to the X-ray tube anode 13. Means for providing this signal are not shown but could be a signal corresponding with the signal that is provided by the exposure control logic 44 for controlling the three-phase transformer primary switch 39.

The other available bias level control voltage is provided by a potentiometer 134. Its wiper connects to the emitter of a transistor switch 135 whose collector is also connected to common line 123 leading to the noninverting input of amplifer 122. The control electrode 136 of this transistor switch is supplied with synchronizing signals corresponding to those which turn on the three-phase switch 54 to cause the lower of the two kilovoltages to be applied to the anode of the X-ray tube. The control signals derived from potentiometers 131 and 134 are selectable which means that the negative bias voltages and, hence, the X-ray tube voltages and corresponding currents are controllable for the high and low energy X-ray pulses.

As explained earlier, the bias voltage on control grid 15 is at or near zero during application of the lower of the anode kilovoltages in which case maximum current flows through the X-ray tube and it produces maximum photon intensities but at low average energy. At this time current through the X-ray tube can be limited by setting the current level through the X-ray tube filament and, hence, its temperature at a value that produces the desired, usually highest, emission current for the low energy pulses. In other words, control grid 15 of the X-ray tube could simply be provided with zero bias voltage during low energy pulses.

IC1 is provided with a pin 137 for input of an optionally used signal that will result in blocking the output of IC1 during the low energy X-ray pulses. The blocking signal results in removing the high energy gating signals from lines 129 and 130 which means that the inverter will turn off during this time so no bias voltage is applied to control grid 15. A logic level signal 138 is used for this purpose. At zero volts IC1 is turned on and at a logic voltage level of 5 volts, for example, IC1 is turned off. The circuit for delivering the pulses 138 cyclically to input pin 137 of IC1 is not shown. It is sufficient to say that the on and off states of IC1 must be synchronized with application of the low and high kilovoltages, respectively, to the X-ray tube anode.

It is important to note that transformers T1 and T2 are identical. Their secondaries are connected in parallel. Thus, the resonant frequency resulting from the parasitic inductance and capacitance of one transformer will be the same as the resonant frequency that results from both transformers. If step-down transformer T2 had different parasitic inductance and capacitance than transformer T1 that resulted in a different resonant frequency, the combination would tend to be resonant at a different frequency. In accordance with the invention, calling the resonant frequency $f_0$ the following expression can be written:

$$f_0 = \frac{1}{2\pi\sqrt{LC}} = \frac{1}{2\pi\sqrt{\frac{L}{2}(2C)}}$$

As one may see, in the second equation, the 2's within the radical cancel in the parallel arrangement so the resonant frequency remains the same as long as the inductance L and the capacitance C factors in the parasitics are identical.

In the actual construction transformers T1 and T2 are air-core transformers. The windings are on an insulating plastic spool, not shown. Thus, the transformers are small and have low weight compared to transformers that use ferrite or other magnetic material for a core. Transformers having magnetic material cores could be used but this would result in core losses that increase with frequency, a problem that is avoided with air-core transformers. In any case, in accordance with the invention, the two transformers should be identical for reasons given heretofore.

Although a preferred embodiment of the invention has been described in detail, such description is intended to be illustrative rather than limiting, for the high voltage power supply and the resonant X-ray tube bias voltage supply can be variously embodied so the scope of the invention is to be limited only by the claims which follow.

We claim:

1. Apparatus for controlling the bias voltage on the control grid of an X-ray tube in connection with the operation of producing alternating X-ray beams having nominally low and high energies where higher X-ray tube current flows during the low energy beams than during the high energy beams, comprising:

an X-ray tube including an anode, a control grid and an electron emissive filament comprising a cathode, means for causing a predetermined current flow through the filament to thereby set the temperature and emissivity of the filament, power supply means for applying alternatingly to said anode the lower of a selected dc kilovoltage and the higher of a selected dc kilovoltage to produce the nominally low and high energy beams, respectively, inverter means operative to output alternating current (ac) signals having a frequency depending on the frequency of switching signals that are input to said inverter means, voltage-to-frequency converter means responsive to input of a variable control voltage signal that is proportional to the desired bias voltage by supplying said switching signals to said inverter means at a frequency corresponding to the value of said control voltage signal, one transformer having a primary winding for being energized with said ac signals and having a secondary winding, said transformer having parasitic capacitance and inductance that results in resonance and maximum voltage output from said secondary winding at one ac signal frequency and results in lower voltage output at frequencies above or below resonant frequency, rectifier means having input terminals for the ac output of said secondary winding and having negative and positive bias voltage output terminals connected respectively to said control grid and filament, and means for controlling said power supply means to apply said low kilovoltage to said X-ray tube anode while said ac frequency is zero or away from the resonant frequency so said bias voltage is less negative and tube current is high and to apply said high voltage to said anode while said ac frequency is at or near resonant frequency so the bias voltage is more negative and said X-ray tube current is lower.

2. Apparatus according to claim 1 including:

a second transformer having characteristics substantially identical to said one transformer, the second transformer having a winding corresponding to the secondary winding of the first transformer and connected in parallel therewith but serving as a primary winding, said second transformer also having a secondary winding, another rectifier means having ac input terminals supplied with said ac signal from the second transformer and having dc output terminals across which a dc signal occurs whose value is related to frequency and to the present bias voltage, said voltage-to-frequency converter including summing amplifier means for comparing said last-named dc signal with said control voltage signal and producing an error signal for altering said switching frequency to bring the bias voltage in correspondence with the control voltage signal.

3. Apparatus in accordance with claim 1 wherein said transformer is an air-core transformer.

4. Apparatus in accordance with claim 2 wherein both of said transformers are air-core transformers.

5. The apparatus in accordance with any of claims 1 or 2 including:

a source of said variable control voltage signal, and switching means for connecting said source to provide said input of said control voltage signal to the voltage-to-frequency converter for controlling the output frequency thereof.

6. The apparatus in accordance with any one of claims 1 or 2 including:

a source of said variable control voltage signal, and switching means for connecting said source to provide said input of said control voltage signal to said voltage-to-frequency converter for determining the output frequency thereof, and means for controlling said switching means to make said connection simultaneously with said high kilovoltage being applied to said X-ray tube anode.

7. The apparatus in accordance with any of claims 1 or 2 including:

first and second sources of said variable control voltage signal, first and second switching means for connecting said sources alternately to provide said input of said control voltage signals to said voltage-to-frequency converter, and means for controlling one of said switching means to connect the first source simultaneously with said high kilovoltage being applied to said X-ray tube anode and to connect the second source simultaneously with said low kilovoltage being applied to the anode.

8. The apparatus in accordance with claim 1 wherein said power supply means comprises:

two three-phase autotransformer assemblies, each having input means for being connected to a three-phase power source and one being adapted to provide a lower output voltage than the other, a step-up transformer having a primary winding and one Y-connected and another delta-connected secondary winding each of which secondary windings have output terminals, three-phase rectifier means for each secondary winding and supplied with alternating current from the output terminals of said Y-connected and delta-connected secondary windings, respectively, said rectifier means being connected in series and the positive side of one being connected to the X-ray tube anode and the negative side of the other being connected to said X-ray tube cathode, first and second switch means and means for controlling said switch means to connect the autotransformer having the lower output voltage to the transformer primary winding and altermately to connect the autotransformer having a higher output voltage to the transformer primary winding.

* * * * *